US007165859B1

(12) United States Patent
Munari

(10) Patent No.: US 7,165,859 B1
(45) Date of Patent: Jan. 23, 2007

(54) LIGHTING DEVICE WITH RESILIENT FASTENER FOR ATTACHING TO HUMAN FINGER

(75) Inventor: Geno Munari, Las Vegas, NV (US)

(73) Assignee: Houdini's Magic Shop, Las Vegas, NV (US)

( * ) Notice: Subject to any disclaimer, the term of this patent is extended or adjusted under 35 U.S.C. 154(b) by 86 days.

(21) Appl. No.: 10/648,655

(22) Filed: Aug. 25, 2003

(51) Int. Cl.
*F21V 21/08* (2006.01)

(52) U.S. Cl. ..... 362/103; 362/109; 362/191; 362/104

(58) Field of Classification Search ..... 362/104, 362/191, 205, 396, 109, 119, 103, 157, 190, 362/202, 362, 363, 368, 370, 382, 800, 806; 446/485, 484; 63/3, 5.1, 6, 15, 15.5, 15.65
See application file for complete search history.

(56) References Cited

U.S. PATENT DOCUMENTS

| | | | | | |
|---|---|---|---|---|---|
| 914,975 | A * | 3/1909 | Radley | 362/310 |
| 1,307,456 | A * | 6/1919 | Prahar | 362/103 |
| 3,392,276 | A * | 7/1968 | Roman | 362/104 |
| 4,012,629 | A * | 3/1977 | Simms | 362/104 |
| 4,093,973 | A * | 6/1978 | Vaagenes | 362/104 |
| 4,422,131 | A * | 12/1983 | Clanton et al. | 362/186 |
| D297,172 | S * | 8/1988 | Flohr | D26/39 |
| D300,260 | S * | 3/1989 | Segeren | D26/39 |
| 5,086,378 | A * | 2/1992 | Prince | 362/103 |
| 5,124,892 | A * | 6/1992 | Lambert | 362/103 |
| 5,193,896 | A * | 3/1993 | Oberlander | 362/104 |
| 5,283,722 | A * | 2/1994 | Koenen et al. | 362/570 |
| 5,448,458 | A * | 9/1995 | Smyly, Jr. | 362/570 |
| 5,450,293 | A * | 9/1995 | Hoffman | 362/570 |
| 5,535,105 | A * | 7/1996 | Koenen et al. | 362/570 |
| 5,622,062 | A * | 4/1997 | Gong-Hwa | 63/15 |
| 5,632,548 | A * | 5/1997 | Mayfarth | 362/103 |
| 5,653,524 | A * | 8/1997 | Gray | 362/104 |
| 5,934,784 | A * | 8/1999 | Dion | 362/103 |
| 6,050,695 | A * | 4/2000 | Fromm | 362/104 |
| 6,540,369 | B1 * | 4/2003 | Granite | 362/104 |
| 6,663,256 | B1 * | 12/2003 | Gobbell | 362/104 |
| 2002/0131266 | A1 * | 9/2002 | Naghi et al. | 362/104 |

* cited by examiner

*Primary Examiner*—Sandra O'Shea
*Assistant Examiner*—Ismael Negron
(74) *Attorney, Agent, or Firm*—Rob L. Phillips; Greenberg Traurig

(57) ABSTRACT

The disclosed device provides a translucent housing containing a light source (e.g., LED) and a power source (e.g., battery) in close proximity. A button at one end of the housing permits a user to activate the LED by applying pressure to the button. The pressure forces the battery into contact with a conductive element which then contacts electrical leads of the LED thereby activating the LED. When the pressure is removed, the LED turns off. The housing is removably attached to a user's fingers or thumb by means of a flexible band, strap or multiple flexible members. In this manner, the lighting device is a one-size fits all device.

32 Claims, 2 Drawing Sheets

FIG. 1
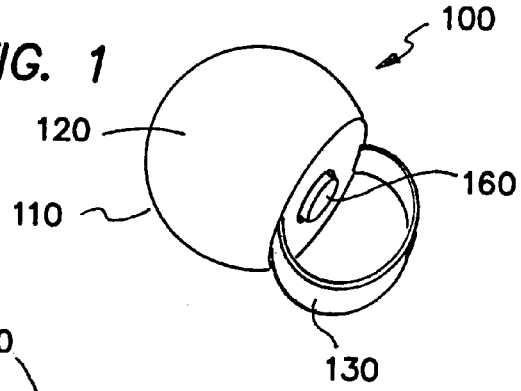
FIG. 2
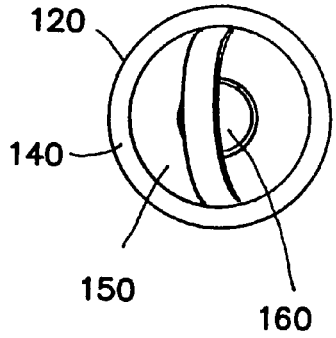
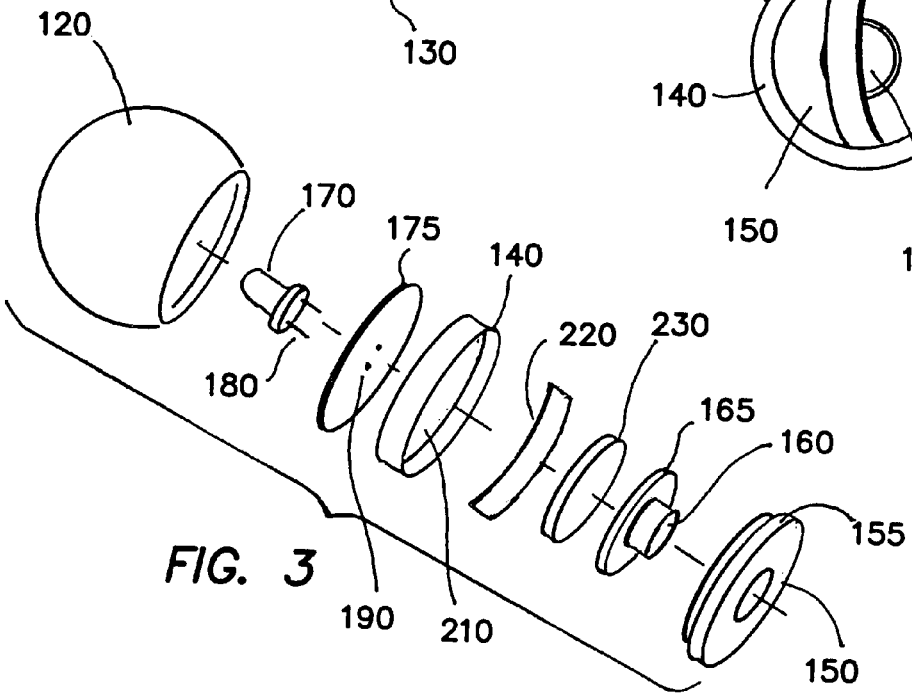
FIG. 3
FIG. 5
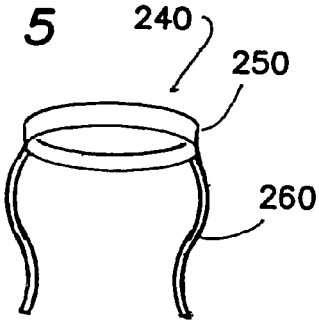
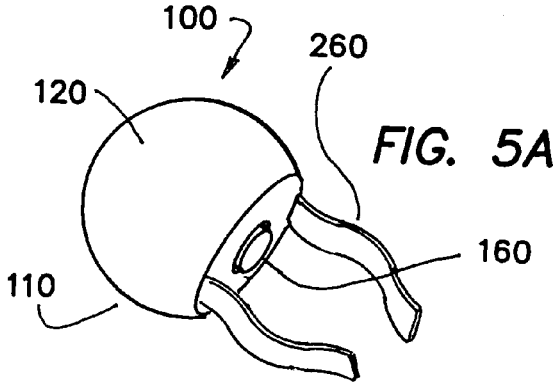
FIG. 5A

LIGHTING DEVICE WITH RESILIENT FASTENER FOR ATTACHING TO HUMAN FINGER

FIELD OF INVENTION

The embodiments of the present invention relate to a lighting device which can be intermittently activated by applying pressure. The device is well-suited for performing magic.

BACKGROUND

Magic and illusions go hand-in-hand and have been around for centuries. More particularly, magic and illusions relying on simple slight of hand have long astounded people. One common magic trick facilitated by slight of hand is that of manipulating a point of light. When practiced correctly, a magician can make the point of light appear out of thin air, move the point of light around, pass the point of light from one hand to another and then make the point of light disappear as quickly as it appeared. To enhance the effect of the trick, the point of light is usually bright red.

While to the uneducated the trick seems impossible, it has been made possible by a simple device which fits over a magician's thumb or finger. In other words, the device can be a housing in the shape and appearance of a thumb or finger as illustrated in U.S. Pat. Nos. 5,632,548 and 4,422,131. In the '548 and '131 patents a light source positioned at the end of a thumb or finger housing provides a concealed means for activating the light source by applying pressure to the end of the thumb or finger housing causing a conductor means to make contact with a power supply thereby activating the light source. The pressure is typically applied by another finger pressed against the end of the housing. The appearance is that the user is holding the point of light between the thumb and finger or between two fingers. Thus, the wearer can activate the light source by applying pressure to the end of the housing and turn off the light source by releasing said pressure.

While the previous devices accomplish their objective, they suffer from several drawbacks. First, no single housing fits all thumb or finger sizes thereby requiring the manufacture of multiple housings of different sizes. Second, the thumb or finger housings only fit over the end of a thumb or finger thereby limiting their versatility. Thus, there is a continued need for a one-size fits all lighting device which can be intermittently and easily activated. Moreover, there is a need for a lighting device which can be attached to any part, including the back, of a thumb or finger.

SUMMARY

Accordingly, the embodiments of the present invention comprise a housing containing a light source, power source and means for intermittently activating said light source. In one embodiment, a flesh-colored latex sheath envelopes the housing to conceal the housing and contained components during use. Alternatively, a semi-translucent flexible plastic, rubber or similar material may be used to envelope the housing. The housing is removably attached to a user's thumb or finger by an elastic band or similar resilient material. In another embodiment, the housing is removably attached using a resilient metal member which encompasses a portion of the user's thumb or finger. In this manner, the housing can be attached to any position along any finger or thumb. Moreover, the resilient attachment material or member permits the fabrication of a one-size fits all lighting device.

Ideally, the light source is a light emitting device (LED) and the power source is a lithium battery. However, other light sources and power sources may be used. While alternative arrangements are possible, a first embodiment of the present invention comprises a LED having its two electrical leads inserted through two corresponding openings in a plate joined to a first collar. The plate encloses a first end of the first collar forming a cavity into which the electrical leads extend. A flat spring is then attached to opposite points of the collar within the cavity. The flat spring is fabricated of a conductive material (e.g., aluminum) and is positioned adjacent to the LED leads without making contact with the LED leads. A circular lithium battery rests atop the flat spring. A button having a lip on a first end rests atop the battery. A second collar, having a diameter slightly smaller than the first collar, is inserted into the cavity such that friction holds the second collar within the cavity. An interior lip on one end of the second collar retains the button and battery within the cavity.

In the arrangement described above, a user applies pressure to the button thereby causing the lithium battery to depress the flat spring into contact with the leads of the LED. Energy from the battery then travels from the battery through the metallic flat spring through the LED leads causing the LED to activate (i.e., produce light). To enhance its illumination, the plate may be fabricated of a reflective material or one surface adjacent the LED may be covered in a reflective materials so that the light emitted by the LED is amplified. By removing the pressure the flat spring returns to its original position out of contact with the LED leads thereby turning off the LED.

BRIEF DESCRIPTION OF THE DRAWINGS

FIG. 1 illustrates a perspective view of a first embodiment of the present invention;

FIG. 2 illustrates a bottom view of the first embodiment of the present invention;

FIG. 3 illustrates an exploded view of the first embodiment of the present invention;

FIG. 5 illustrates a metallic member for facilitating a second embodiment of the present invention;

FIG. 5A illustrates a second embodiment of the present invention wherein an elastic band has been replaced with flexible metallic member.

DETAILED DESCRIPTION

Figure 4:
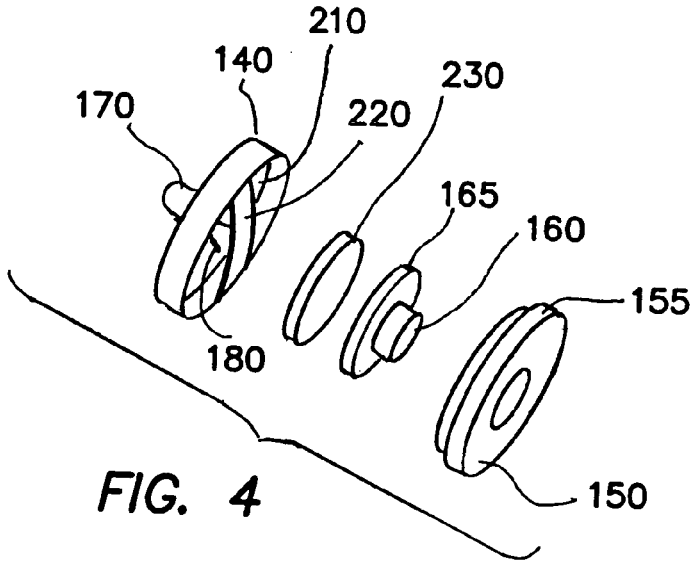
FIG. 4 illustrates a perspective, partially exploded and partially assembled, bottom view of the first embodiment of the present invention with a housing and sheath removed.

Reference is now made to the figures wherein like parts are referred to by like numerals throughout. FIG. 1 illustrates a perspective view of a first embodiment of an intermittently activated lighting device generally designated as reference numeral 100. The lighting device 100 includes a housing 110, having a sheath covering 120, and an elastic band 130 for attaching the lighting device 100 to a user's thumb or fingers. Any resilient material can be used to attach the lighting device 100 to a user's thumb or fingers. Such a resilient material provides versatility as described below and allows for easy and concealed removal of the lighting device 100 at the conclusion of the illusion. Moreover, with a resilient material the device 100 can be positioned on a front, side or rear of the thumb or finger The housing 110 can take any form, including a plastic bulb, providing it protects and conceals the components of the device 100. In an alternative embodiment, a housing is fabricated of a resin, epoxy or similar material which solidifies directly on and about at least a light source, preferably a LED, of the device 100. Moreover, the housing 110 is translucent or includes one or more openings for allowing light from the light source to escape from the housing 110.

Now referring to FIG. 2, a first collar 140 encapsulates a second collar 150. A button 160 protrudes from an opening in the second collar 150. The button 160 extends through an opening of the second collar 150 such that the user can apply pressure to the button 160 to activate, as described below, a light source contained within the housing 110.

FIG. 3 illustrates an exploded view of the lighting device 100. Ideally, the sheath covering 120 is flesh-colored latex to conceal the lighting device during its use. Also, the sheath 120 material is translucent to allow light from LED 170 to escape the housing 110 and be observed by onlookers. It is also practical to cover the housing with other materials, such as rubber or paint, as long as the material is translucent. Although any color LED is available, for performing magic, it is preferred that the LED 170 emit red light. The LED 170 can be any common LED. For example, a red 5 mm, 1.7 volt, LED sold by RadioShack® has been found to perform well. To enhance the effectiveness of the LED 170, a reflective film 175 is adhered to a surface of the first collar 140. In this manner, the light from the LED 170 is made more brilliant.

Electrical leads 180 of the LED 170 insert through corresponding openings 190 in the film 175 and first collar 140 such that the leads 180 extend into cavity 210. The LED 170 can then be permanently attached to the first collar 140 by means of glue, epoxy or other substance. A flat spring 220 is inserted into cavity 210 and connected to opposite sides of the first collar 140 in an alignment that, when the flat spring 220 is depressed, it contacts both leads 180 of the LED 170. The flat spring 220 may be glued to opposite sides of the first collar 140 and/or may be inserted into corresponding slots in an interior surface of the first collar 140. A battery 230 then rests atop the flat spring 220 such that an active surface 240 (i.e., power emitting surface) of the battery is in contact with the flat spring 220. Although any battery may be used to drive the lighting device 100, a lithium battery provides ample power and has acceptable dimensions to power the lighting device 100. For example, a 3.0 v lithium battery, having model number CR1216, as sold by RadioShack® has been found to work well.

Although a flat spring 220 has been described, any conductive flexible material can be used to transfer power from the battery 230 to the LED leads 180. Ideally, the flexible material should return to an original position after being displaced by force thereby allowing the material to intermittently contact the LED leads 180 as desired by a user.

By resting atop the battery 230, the button 160 provides a means for the user to intermittently activate the lighting device 100. The second collar 150 includes an exterior lip 155 around one end thereof. Upon insertion of the second collar 150 into the cavity 210 of the first collar 140, the lip 155 prevents the second collar 150 from being inserted into the cavity 210 more than a desired distance. The second collar 150 snaps in place within the first collar 140 and is held in place in the first collar 140 by friction. Alternatively or additionally, the second collar 150 can be held in place with an adhesive, such as glue. An exterior lip 165 around a first end of the button 160, in contact with the battery 230, functions to prevent the button 160 from exiting the confines of the cavity 210 through the opening of the second collar 150.

It should be apparent that numerous different lighting device designs are possible without departing from the scope and spirit of the embodiments of the present invention. For example, a second collar having the same diameter as a first collar can be joined to one another to encompass a properly positioned conductive material, battery and button to form an elongated cavity. In such an arrangement, the button may need to have a greater height for access by a user's finger or thumb.

FIG. 4 illustrates a partially assembled device, including the LED 170, the first collar 140 and the flat spring 220 in a completed arrangement. Also evident in FIG. 4 are the leads 180 of the LED 170 extending through the film 175 and corresponding surface of the first collar 140. The battery 230, second collar 150 and button 160 are shown in an exploded fashion.

FIG. 5 illustrates an alternative device for removably attaching the device 100 to a thumb or finger. A metallic member 240 includes a loop member 250 and two legs 260 extending therefrom. The legs 260 initially extend outward from said loop member 250 and then bow inward to form a partial enclosure for securing the member 240 to a thumb or finger. The legs 260 are flexible to permit a thumb or finger to be inserted between the ends of the legs 260 and into the partial enclosure with relative ease. The flexibility also permits easy thumb and finger removal from the partial enclosure. In addition, the flexible legs 260 permit the member 240 to be easily manipulated about the thumb or finger in the same manner as the elastic band 130. For concealment, the metallic member 240 is painted with a flesh tone material. FIG. 5A illustrates the metallic member 240 integrated into the complete device 100.

Figure 6:
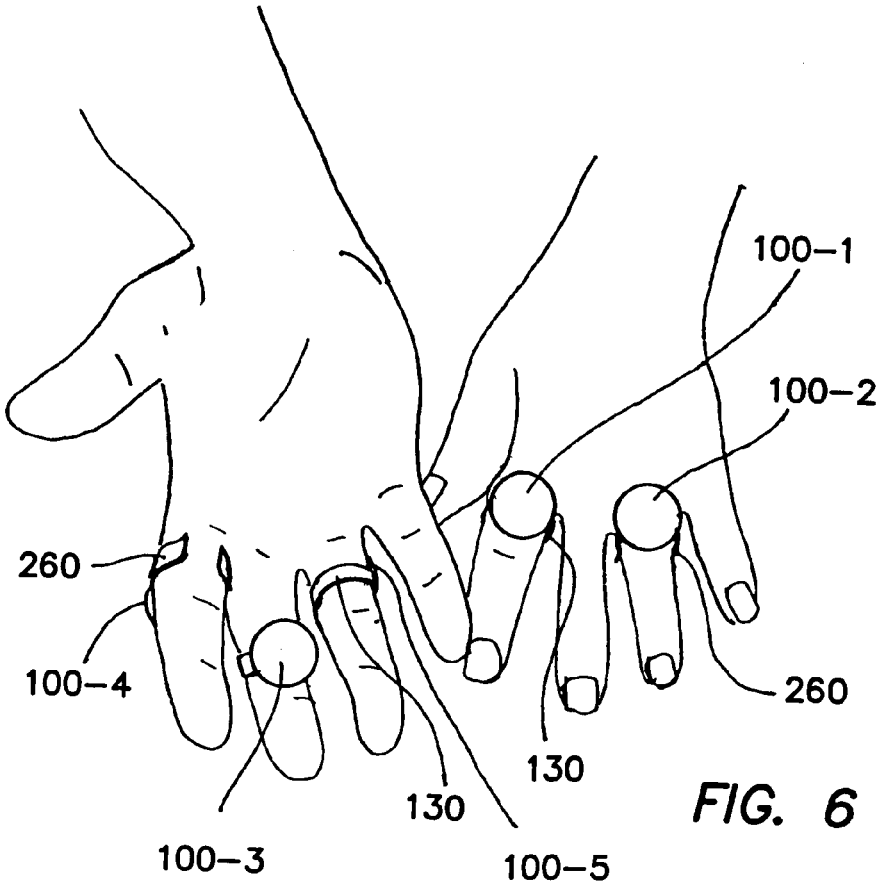
FIG. 6 illustrates multiple locations for attaching the first embodiment of the present invention to a user's thumb and fingers.

FIG. 6 illustrates the versatility of the device 100. Multiple devices 100-1 through 100-5 show the device's versatility. Besides versatility, the elastic band 130 and flexible metallic member 240, in combination with the unique design, of each device 100-1 through 100-5 provides for easy removal of the devices 100-1 through 100-5 when an illusion is completed. Also possible with the embodiments of the present invention is the simultaneous use of multiple devices 100-1 through 100-5 to create new and more complex illusions with multiple points of light.

Besides a bulb, the device 100 can take any shape or form which provides a user with ease of operation, concealment and removal. In addition, smaller light sources will provide an even more compact design thereby facilitating greater concealment. In addition, the first collar 140, second collar 150, button 160 are preferably fabricated of non-conductive materials, such as plastic or rubber, to prevent any electrical shock to a user.

Therefore, although the invention has been described in detail with reference to several embodiments, additional variations and modifications exist within the scope and spirit of the invention as described and defined in the following claims.

I claim:

1. An intermittently activated lighting device comprising:

a housing;

a light source within said housing;

a power source within said housing;

means for intermittently activating said light source, wherein said means comprises a button extending from a bottom portion of the housing such that the button is in contact with a non-tip portion of a human finger or thumb on which the device is attached;

a resilient strap for removably attaching said housing to the human finger or thumb without activating said light source; and wherein when activated, a portion of the emitted light is normal to the human finger or thumb.

2. The intermittently activated lighting device of claim 1 wherein the light source is a light emitting diode.

3. The intermittently activated lighting device of claim 1 wherein the power source is a lithium battery.

4. The intermittently activated lighting device of claim 1 wherein applying pressure to the button causes the power source to activate the light source as long as the pressure is applied to the button.

5. The intermittently activated lighting device of claim 1 wherein the resilient strap is elastic.

6. The intermittently activated lighting device of claim 1 further comprising a flesh-colored sheath for covering said housing.

7. The intermittently activated lighting device of claim 1 wherein the housing is translucent.

8. An intermittently activated lighting device comprising:

a housing containing a light source and a power source;

a button extending from a bottom portion of the housing such that the button is in contact with a non-tip portion of a human finger or thumb on which the device is attached whereby applying pressure to said button closes an open electrical circuit to activate said light source;

a resilient strap for removably attaching said housing to the human finger or thumb without activating said light source; and wherein when activated, a portion of the emitted light is normal to the human finger or thumb.

9. The intermittently activated lighting device of claim 8 wherein the light source is a light emitting diode.

10. The intermittently activated lighting device of claim 8 wherein the power source is a lithium battery.

11. The intermittently activated lighting device of claim 8 wherein the resilient strap is elastic.

12. The intermittently activated lighting device of claim 8 further comprising a flesh-colored covering for said housing.

13. An intermittently activated lighting device comprising:

a housing;

a light source within said housing;

a power source within said housing;

means for intermittently activating said light source, wherein said means comprises a button extending from a bottom portion of the housing such that the button is in contact with a non-tip portion of a human finger or thumb on which the device is attached;

two or more flexible members for removably attaching said housing to the human finger or thumb without activating said light source; and wherein when activated, a portion of the emitted light is normal to the human finger or thumb.

14. The intermittently activated lighting device of claim 13 wherein the light source is a light emitting diode.

15. The intermittently activated lighting device of claim 13 wherein the power source is a lithium battery.

16. The intermittently activated lighting device of claim 13 wherein applying pressure to the button causes the power source to activate the light source as long as the pressure is applied to the button.

17. The intermittently activated lighting device of claim 13 wherein the flexible members are metallic.

18. The intermittently activated lighting device of claim 13 further comprising a flesh-colored sheath for covering said housing.

19. The intermittently activated lighting device of claim 13 wherein the housing is translucent.

20. An intermittently activated lighting device comprising:

a housing containing a light source and a power source;

a button extending from a bottom portion of the housing such that the button is in contact with a non-tip portion of a human finger or thumb on which the device is attached whereby applying pressure to said button closes an open electrical circuit to activate said light source;

two or more flexible members for removably attaching said housing to the human finger or thumb without activating said light source; and wherein when activated, a portion of the emitted light is normal to the human finger or thumb.

21. The intermittently activated lighting device of claim 20 wherein the light source is a light emitting diode.

22. The intermittently activated lighting device of claim 20 wherein the power source is a lithium battery.

23. The intermittently activated lighting device of claim 20 wherein the flexible members are metallic.

24. The intermittently activated lighting device of claim 20 further comprising a flesh-colored covering for said housing.

25. A method of performing an illusion of manipulating a point of light comprising:

attaching one or more intermittently activated lighting devices to fingers or thumbs without activating the one or more light sources, said attaching being facilitated by a resilient strap; and applying intermittent pressure to a button extending from a bottom portion of a housing, wherein the button is in contact with a non-tip portion of the fingers or thumbs on which the one or more lighting devices are attached, thereby intermittently activating the one or more light sources and wherein a portion of the emitted light from the one or more light sources is normal to the fingers or thumbs.

26. The method of claim 25 wherein the light source is a light emitting diode.

27. The method of claim 25 wherein the light source is powered by a battery.

28. The method of claim 25 wherein the device has a flesh-colored tone.

29. A method of performing an illusion of manipulating a point of light comprising:

attaching one or more intermittently activated lighting devices to fingers or thumbs without activating said light source, said attaching being facilitated by two or more flexible members; and applying intermittent pressure to a button extending from a bottom portion of a housing, wherein the button is in contact with a non-tip portion of the fingers or thumbs on which the one or more lighting devices are attached, thereby intermittently activating the one or more light sources and wherein a portion of the emitted light from the one or more light sources is normal to the fingers or thumbs.

30. The method of claim 29 wherein the light source is a light emitting diode.

31. The method of claim 29 wherein the light source is powered by a battery.

32. The method of claim 29 wherein the device has a flesh-colored tone.

* * * * *